United States Patent [19]

Shimizu

[11] Patent Number: 4,572,242

[45] Date of Patent: Feb. 25, 1986

[54] HEALD FRAME ASSEMBLY

[75] Inventor: Yoichi Shimizu, Izumi, Japan

[73] Assignee: Maruyama Mfg. Co., Ltd., Osaka, Japan

[21] Appl. No.: 666,869

[22] Filed: Oct. 30, 1984

[30] Foreign Application Priority Data

Nov. 9, 1983 [JP] Japan ..... 58-173931[U]
Nov. 17, 1983 [JP] Japan ..... 58-177668[U]

[51] Int. Cl.[4] ..... D03C 9/06
[52] U.S. Cl. ..... 139/91
[58] Field of Search ..... 139/91, 92

[56] References Cited

U.S. PATENT DOCUMENTS 3,424,205 1/1969 Koch ..... 139/91
3,970,114 7/1976 Baumann ..... 139/91
4,091,844 5/1978 Underwood ..... 139/91

*Primary Examiner*—Henry S. Jaudon
*Attorney, Agent, or Firm*—Edwin E. Greigg

[57] ABSTRACT

A heald frame assembly comprising a plurality of heald frames which are provided with at least one guide plate which contacts with another guide plate on the heald frame adjacent the heald frame having the said one guide plate. The guide plates are so constructed as to make plastic to metal contact in this assembly.

2 Claims, 8 Drawing Figures

HEALD FRAME ASSEMBLY

BACKGROUND OF THE INVENTION

The present invention relates to a heald frame assembly for a loom.

A heald frame of the heald frame assembly has one or a number of guide plates on its upper and lower transverse beams respectively so as to make an opening motion of the heald frame assembly to strings in such a state that up and down movements of the heald frame assembly attached to the loom body may be carried out smoothly and that the heald frames contacting one another may not be broken with contact thereof. A guide plate in the prior art is normally made of plastic or wood. At least both of the front and rear sides of the guide plate are made of plastic or wood.

The guide plates in the prior art have the following drawbacks. Namely, regarding the former guide plate made of plastic, it is advantageous in manufacturing costs since it is possible to make mass-production of the guide plates by plastic molding, but the guide plates locating adjacent to one another are heavily worn out and sometimes fused. Thus, there is a weakness in durability. Regarding the latter wood guide plate also has a weakness in durability since it tends to scorch due to friction between the guide plates locating adjacent to one another. Further, such a wood guide plate is normally low in strength and so easily broken and therefore it cannot be bolted to a heald frame. Accordingly, the wood plate has to be fixed to the heald frame by means of an adhesive agent. By the reason, it is very troublesome in assembling the guide plates to the heald frame and in maintenance. Further, there is a disadvantage in manufacturing costs since for example a wood guide plate is not adapted for mass-production.

These disadvantages in the prior art becomes remarkable in proportion to speed-up of a loom, recently.

SUMMARY OF THE INVENTION

The present invention has been achieved in view of the above mentioned circumstances and its object is to provide a heald frame assembly having guide plates which are tough in wearing, fusing or scorching under friction between guide plates locating adjacent to one another which move up and down with high speed. Further, another object of the present invention is to provide a heald frame assembly which is better in manufacturing and assembling and also adapted for mass-production.

In order to achieve the above mentioned objects, a heald frame assembly according to the present invention comprises at least two adjacent heald frames, each being provided with at least one guide plate so that the guide plates on the adjacent heald frames are contacted to each other, characterized in that a portion of the guide plate on said one heald frame contacting the guide plate on said another adjacent heald frame is made of plastic and that a portion of the guide plate on said another heald frame contacting the said portion of the guide plate on said one heald frame is made of metal.

The function and the advantages obtained by the above mentioned characteristic construction are as follows:

In the state that a plurality of heald frames are disposed on a loom in parallel with one another, guide plates locating adjacent to one another can be contacted with the plastic surface and the metal surface thereof.

Due to the difference between their coefficients of friction and also the good radiation characteristic of the metal surface of the metal guide plate, when the contacting surfaces of the guide plates move frictionally relative to one another with high speed, the contacting surfaces were not heated to a high temperature. Therefore, wearing, fusing or scorching of the surfaces of the guide plates which occurs in the prior art of plastic to plastic contact or wood to wood contact, is effectively prevented and durability of the guide plates can be increased greatly. Further, since one side of the guide plate is made of plastic, there occurs no noise, which is in the prior art produced by contact between the guide plates having metal surfaces, and further weight of the guide plate can be controlled as light as possible. Furthermore, as will be apparent from the following description of an embodiment of this invention, where a side portion of the guide plate made of plastic may be formed in the same manner of plastic molding in the prior art and the other side thereof made of metal may be formed with pressing process, the guide plate may be easilt manufactured by mass-production. In this case, it is advantageous in both of assembling efficiency and productivity.

Other advantages of the present invention will be apparent from the following description.

BRIEF DESCRIPTION OF THE DRAWINGS

The drawings show an embodiment of a heald frame assembly according to the present invention in which.

DESCRIPTION OF THE PREFERRED EMBODIMENTS

Figure 1:
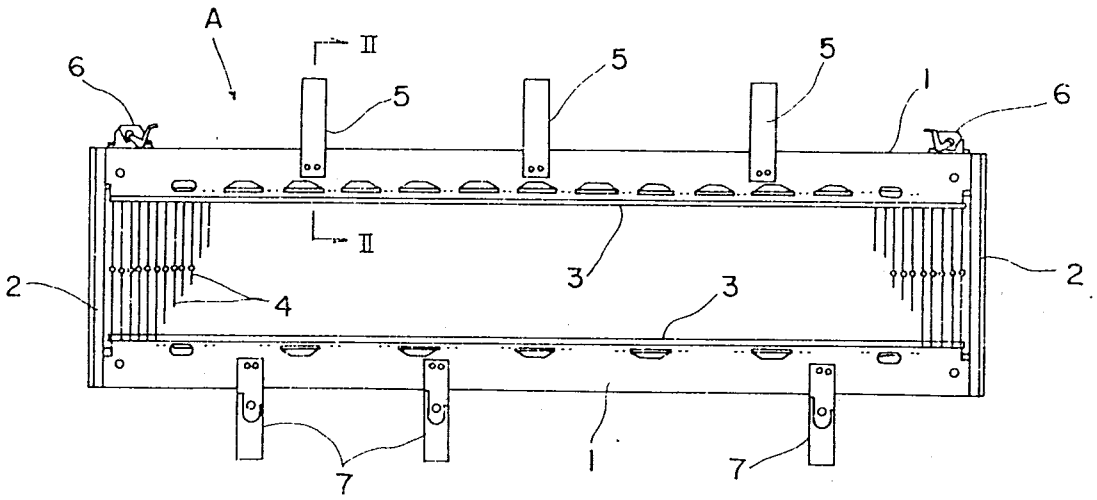
FIG. 1 is an overall front view of a heald frame.

As shown in FIG. 1, an upper and lower transverse beams 1 are fixedly connected to each other by means of a left and right side stays 2. A heald bar 3 is attached to the lower edge of the upper transverse beam 1 and the upper edge of the lower transverse beam 1, respectively. A number of healds 4 are arranged on the upper and lower heald bars 3. Guide plates 5 and hanger hooks 6 are attached to the upper transverse beam or stave 1 and foldable guide plates 7 are attached to the lower transverse beam or stave 1. Thus, a heald frame A of riderless type is constructed.

At least two heald frames or heddles A constructed in the above mentioned manner, are assembled into a heald frame assembly and attached to or mounted on a loom body in such a state that the front and/or rear side surfaces of the guide plates 5 and 7 are slidably moved in up and down in contact with the front or rear side surface of the guide plates 5 and 7 of the heald frame which is located adjacent to the former heald frame A.

Figure 2:
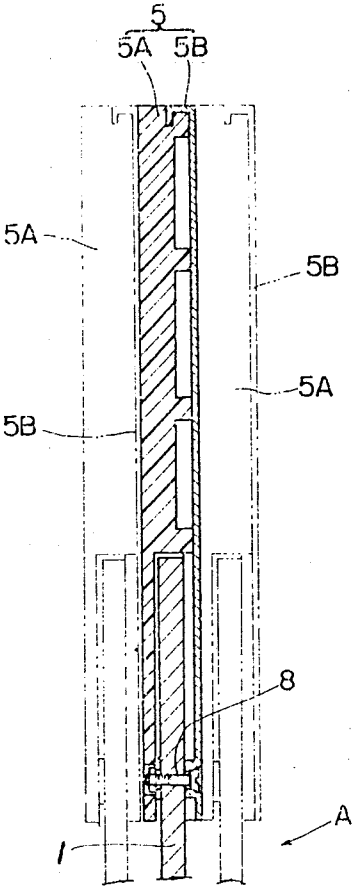
FIG. 2 is a sectional view taken on line II—II of FIG. 1.

Each of the upper guide plates 5 is constructed, as shown in FIG. 2, by a side plate 5A of plastic (the front side in this embodiment) which is manufactured by plastic molding, and by the other side plate 5B of metal (the rear side in this embodiment) which is manufactured by pressing process of metal such as steel or aluminium. The upper guide plates 5 are secured to the upper transverse beam 1 in such a manner that the side plate 5A and the other side plate 5B are engagingly connected to each other at the upper portions thereof and are connected to each other at the the lower portions thereof by means of bolts and nuts 8 while catching the upper transverse beam 1. As shown by phantom lines in FIG. 2, both of the guide plates 5 of the adjacent heald frames A are attached in the same direction so that the plastic side plate 5A of a certain guide plate 5 and the metal side plate 5B of the other guide plate 5 adjacent the said guide plate 5, may be contacted with each other.

Figure 3:
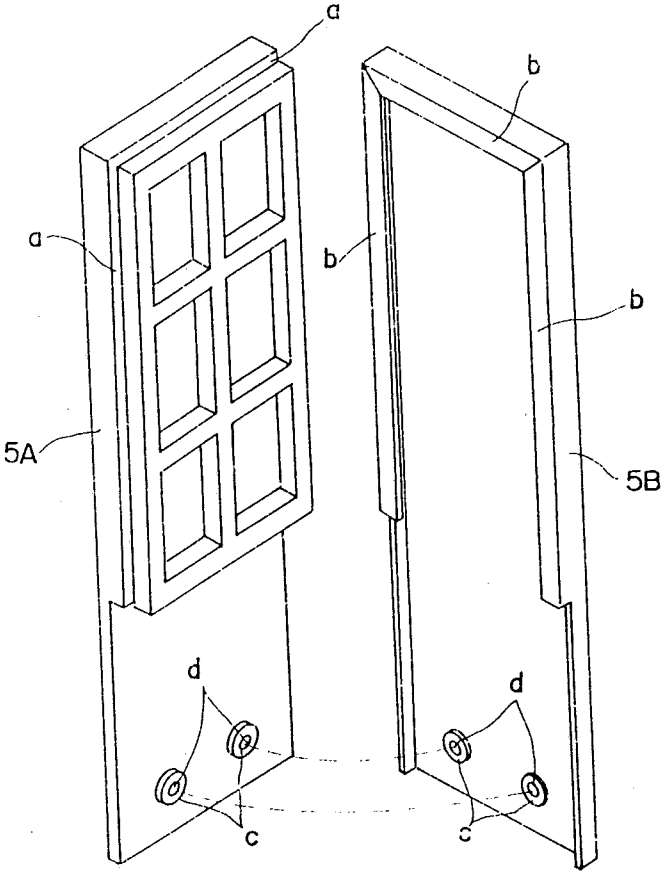
FIG. 3 is an assembling perspective view of the essential portion of the heald frame.

FIG. 3 is an assembling perspective view showing in detail the construction of the upper guide plate 5. Engaging grooves a are formed with the upper edge and the both side edges of the upper thick portion of the plastic side plate 5A of the guide plate 5. On the other hand, flanges b are formed with the upper portion of the metal side plate 5B so as to engage with the engaging grooves a of the plastic side plate 5A. The symbol c indicates projections formed with the lower inside surfaces of each of the side plates 5A and 5B and for defining the lower clearance between the side plates 5A and 5B, and at a center of each of the projections c, bolt openings d are bored. After both of the side plates 5A and 5B have been engaged with each other in the up and down directions, the upper transverse beam 1 is inserted into the clearance formed between the lower portions of the side plates 5A and 5B and then secured to each other by means of the bolts and nuts 8.

Figure 4:
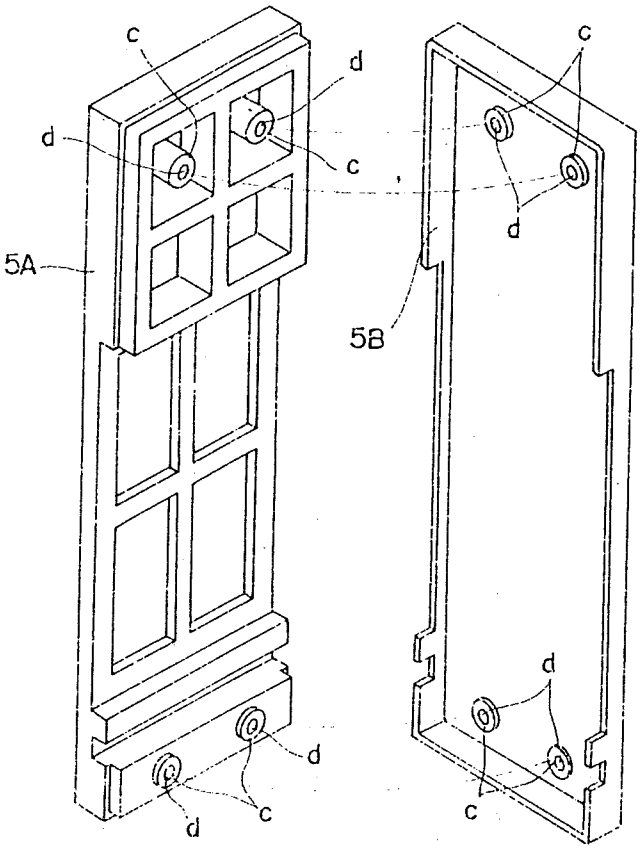
FIG. 4 is an assembling perspective view of the essential portion of a heald frame of another embodiment.

FIG. 4 shows an assembling perspective view of an upper guide plate 5 relating to another embodiment. A plastic side plate 5A and a metal side plate 5B are bolted (not shown) to each other at both of the upper and lower edge portions thereof in such a state that the upper transverse beam 1 is caught by the intermediate portions (slightly close to the lower portions) of the side plates in the vertical direction (not shown). The heald frame A utilizing this guide plate is normally called "cross type" against the riderless type of the above first embodiment.

The above mentioned embodiment shows a type in which the plastic side plate 5A and the metal side plate 5B are connected by fitting engagement and bolt-nut connection in combination or only by bolt-nut connection. However, as connecting means for the side plates 5A and 5B, only fitting engagement may be utilized and an adhesive agent may be used in combination or independently. In other words, connecting means for the side plates 5A and 5B is not an essential element of this invention claimed for achieving the first object.

It should be noted that this invention includes in the scope thereof such a construction that to construct a simple guide plate a metal plate is applied to a side of a guide plate of the prior art made of plastic. Of couse, the present invention may apply to the lower guide plates 7.

FIGS. 5 to 8 show further embodiments.

Figure 5:
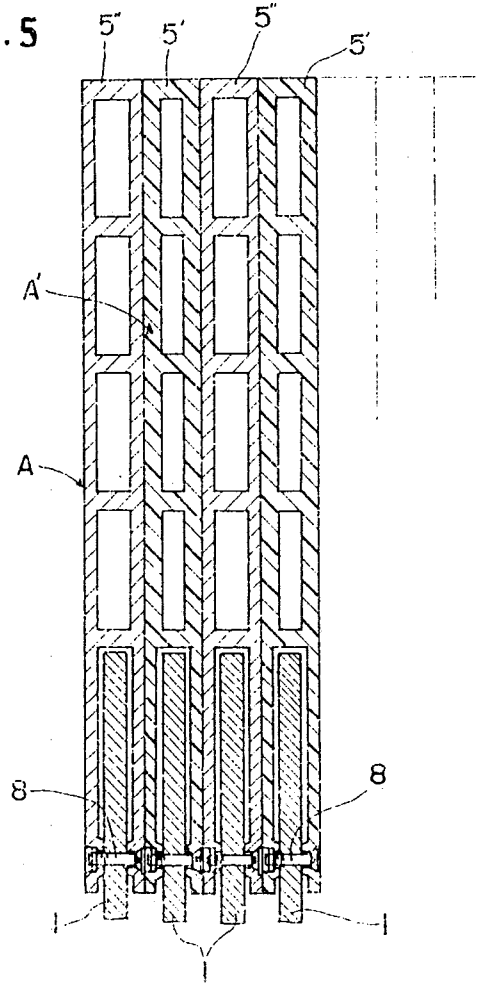
FIG. 5 is a sectional view of the essential portion of a heald frame of a further embodiment.

In one of the embodiments, each of upper guide plates in different types is attached to heald frames A which are located adjacent to one another. As shown in FIG. 5, a plastic guide plate 5' is attached to an upper transverse beam 1 of a certain heald frame A by means of bolts and nuts 8 in such a state that the upper transverse beam 1 is caught by the lower portion of the guide plate. On the other hand, each of all metal upper guide plates 5'' and 5'' is connected to each of the upper transverse beam 1 and 1 of heald frames A' and A' which are located adjacent each side of the said certain heald frame A. Namely, the guide plate 5' both side surfaces of which are made of plastic and the guide plate 5'' both side surfaces of which are made of metal, are disposed alternately in the direction of arrangement of the heald frames A. Thus, the guide plates 5' and and 5'' which are located adjacent to one another, are constructed to be contacted to one another by the metal surface to the plastic surface.

Figure 6:
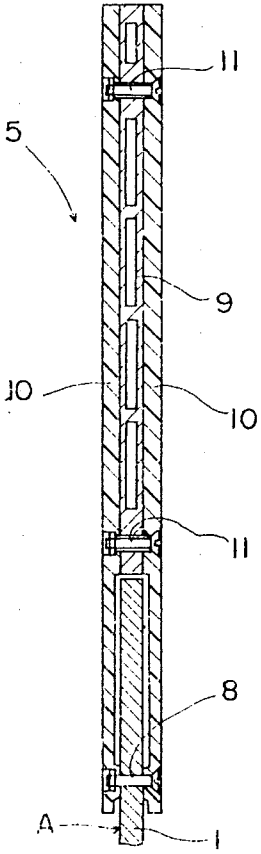
FIG. 6 is a sectional view of the essential portion of a heald frame of another embodiment.

In the above embodiment, as the guide plate 5' having the plastic surfaces, all plastic material is used. However, as shown in FIG. 6, the guide plate may be constructed such that side plates 10 and 10 made of plastic are secured to both sides of a first intermediate member 9 made of metal (such as steel or aluminium) by means of bolts and nuts 11, adhesion, fitting engagement or so forth. Further, in the above embodiment, as the guide plate 5'', all metal material is used. However, instead of the material, as shown in FIG. 7, side plates 13 and 13 made of plastic are secured to both sides of a second intermediate member 12 by means of bolts and nuts 14 or such connecting means.

Figure 7:
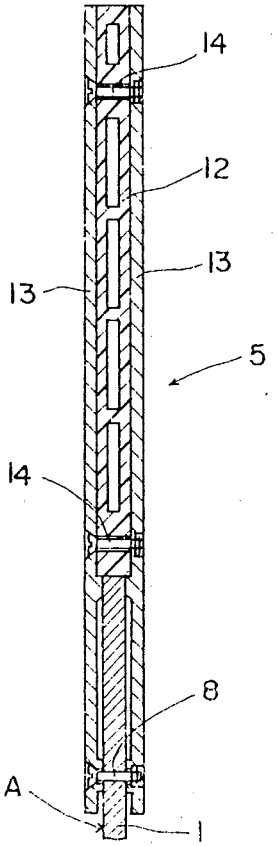
FIG. 7 is a sectional view of a heald frame used adjacent to the heald frame of FIG. 6.

Further, as combinations of the two kinds of the guide plates 5' and 5'', it may be chosen desirably from the embodiments as shown in FIGS. 5 to 7, and particularly when combining the guide plate 5' of FIG. 6 and the guide plate 5'' of FIG. 7, it is advantageous of making the weight defference between the guide plates 5' and 5'' very small.

Figure 8:
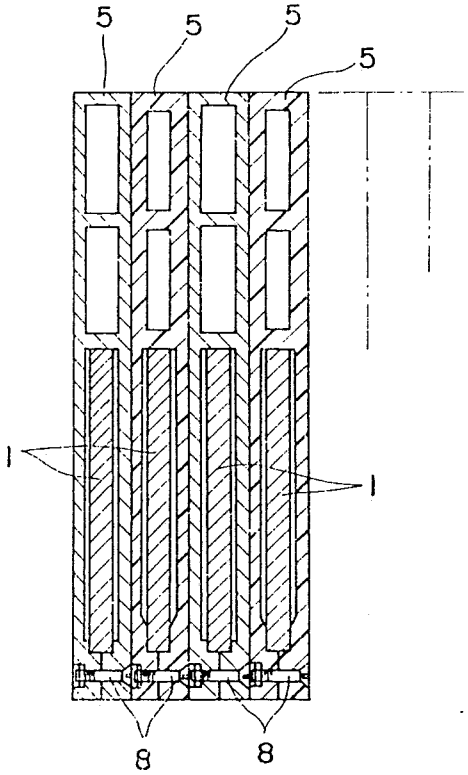
FIG. 8 is a sectional view of a heald frame of a further embodiment.

FIG. 8 shows a further embodiment in which the present invention is applied to a heald frame A of cross type. In this embodiment, an upper guide plate 5 catches an upper transverse beam 1 at an intermediate portion thereof (slightly close to the lower portion thereof) and is connected to the beam 1 by means of bolts and nuts 8, and the other construction thereof is substantially the same as that of riderless type shown in FIG. 5.

What is claimed is:

1. In a heddle frame of a loom including upper and lower staves having front and rear surfaces and spaced lateral supports, the combination comprising a pair of lockable guide plates of predetermined extent, each of said guide plates having lower portions adapted to engage said front and rear surfaces of said stave, one of said guide plates comprising a metal element having a main body portion, and further including at least top end and side locking means spaced from said main body portion and a complemental guide plate comprising a plastic element having a main body portion, said plastic element further including at least a pair of spaced means for locking engagement with said top end and said side locking means of said main body portion said pair of guide plates being lockable upon sliding movement thereof relative to said staves whereupon threaded fasteners are passsed through means defining apertures in said staves and said guide means.

2. In a heddle frame as described in claim 1, further wherein said plastic element has inner and outer surface areas, said inner surface area adjacent to said spaced means for locking engagement with said metal element further including an offstanding frame-like portion subdivided into a plurality of box-like pockets having offstanding ribs of equal length, said offstanding ribs being arranged to engage an inner surface of said metal element upon assembly therewith.

* * * * *